US009951974B2

(12) United States Patent
Huff et al.

(10) Patent No.: US 9,951,974 B2
(45) Date of Patent: Apr. 24, 2018

(54) FLASH TANK ECONOMIZER CYCLE CONTROL

(75) Inventors: Hans-Joachim Huff, Berlin (DE); Jason Scarcella, Cicero, NY (US)

(73) Assignee: CARRIER CORPORATION, Farmington, CT (US)

( * ) Notice: Subject to any disclaimer, the term of this patent is extended or adjusted under 35 U.S.C. 154(b) by 1668 days.

(21) Appl. No.: 13/062,802

(22) PCT Filed: Aug. 28, 2009

(86) PCT No.: PCT/US2009/055358

§ 371 (c)(1),
(2), (4) Date: Mar. 8, 2011

(87) PCT Pub. No.: WO2010/036480

PCT Pub. Date: Apr. 1, 2010

(65) Prior Publication Data

US 2011/0162397 A1 Jul. 7, 2011

Related U.S. Application Data

(60) Provisional application No. 61/100,941, filed on Sep. 29, 2008.

(51) Int. Cl.
*F25B 1/10* (2006.01)

(52) U.S. Cl.
CPC ..... *F25B 1/10* (2013.01); *F25B 2309/061* (2013.01); *F25B 2400/13* (2013.01);
(Continued)

(58) Field of Classification Search
CPC .. F25B 1/10; F25B 2309/061; F25B 2400/13; F25B 2400/23; F25B 2500/07;
(Continued)

(56) References Cited

U.S. PATENT DOCUMENTS 5,174,123 A 12/1992 Erickson
5,189,885 A 3/1993 Ni
(Continued)

FOREIGN PATENT DOCUMENTS

EP 1207359 A2 5/2002
JP H04340046 A 11/1992
(Continued)

OTHER PUBLICATIONS

International Preliminary Report on Patentability dated Apr. 7, 2011.
(Continued)

*Primary Examiner* — Elizabeth Martin
*Assistant Examiner* — Zachary R Anderegg
(74) *Attorney, Agent, or Firm* — Cantor Colburn LLP

(57) ABSTRACT

A flash tank economizer includes a sensor for sensing a condition indicative of pressure in the flash tank, and when that pressure is found to equal or exceed the critical pressure of the particular refrigerant being used, a controller responsively closes a valve in the economizer vapor line to shut off the economizer. A sensor is also provided to sense the pressure at the compressor mid-stage, and if that pressure is found to exceed the pressure in the flash tank, the controller causes the flow control device to function so as to prevent the flow of refrigerant from the compressor mid-stage to the flash tank. Provision is also made for selectively draining refrigerant from the flash tank to reduce the pressure therein from a supercritical to a subcritical condition.

9 Claims, 4 Drawing Sheets

(52) U.S. Cl.
CPC ..... *F25B 2400/23* (2013.01); *F25B 2500/07* (2013.01); *F25B 2600/2509* (2013.01); *F25B 2700/19* (2013.01); *F25B 2700/193* (2013.01); *F25B 2700/2109* (2013.01)

(58) Field of Classification Search
CPC ..... F25B 2600/2509; F25B 2700/19; F25B 2700/193; F25B 2700/2109
USPC ..... 62/196.1, 196.2, 197, 510, 509
See application file for complete search history.

(56) References Cited

U.S. PATENT DOCUMENTS

| | | | | |
|---|---|---|---|---|
| 5,692,389 | A | 12/1997 | Lord et al. | |
| 5,829,265 | A | 11/1998 | Lord et al. | |
| 6,202,438 | B1 | 3/2001 | Barito | |
| 6,385,980 | B1 * | 5/2002 | Sienel | 62/174 |
| 6,708,510 | B2 * | 3/2004 | Sulc et al. | 62/151 |
| 7,096,679 | B2 | 8/2006 | Manole | |
| 7,204,099 | B2 | 4/2007 | Lifson et al. | |
| 7,275,385 | B2 | 10/2007 | Abel et al. | |
| 7,299,649 | B2 | 11/2007 | Healy et al. | |
| 7,353,659 | B2 | 4/2008 | Crane et al. | |
| 2005/0240338 | A1 | 10/2005 | Ardisana | |
| 2005/0262859 | A1 | 12/2005 | Crane et al. | |
| 2006/0277932 | A1 * | 12/2006 | Otake et al. | 62/196.1 |
| 2006/0277941 | A1 | 12/2006 | Lifson et al. | |
| 2007/0151266 | A1 | 7/2007 | Yakumaru et al. | |
| 2008/0053136 | A1 | 3/2008 | Pham et al. | |
| 2008/0092573 | A1 | 4/2008 | Vaisman et al. | |
| 2009/0044564 | A1 | 2/2009 | Okamoto | |

FOREIGN PATENT DOCUMENTS

| | | | |
|---|---|---|---|
| JP | H11304269 | A | 11/1999 |
| JP | 200133058 | A | 5/2001 |
| JP | 2002195673 | A | 7/2002 |
| JP | 2006138525 | A | 6/2006 |
| JP | 2006161659 | A | 6/2006 |
| JP | 2006343017 | A | 12/2006 |
| KR | 20070082501 | A | 8/2007 |
| WO | 2007094618 | A2 | 8/2007 |
| WO | WO 2007094618 | A2 * | 8/2007 |
| WO | WO2007105440 | A1 | 9/2007 |

OTHER PUBLICATIONS

International Search Report and Written Opinion dated Apr. 12, 2010.

Extended European Search Report, Supplementary European Search Report, and European Search Opinion for International Application No. PCT/US2009/055358, Apr. 16, 2014, 12 pages.

* cited by examiner

FLASH TANK ECONOMIZER CYCLE CONTROL

CROSS REFERENCE TO RELATED APPLICATION

This PCT application claims priority to U.S. Provisional Patent Application No. 61/100,941, entitled "Flash Tank Economizer Cycle Control" filed Sep. 29, 2008 which is incorporated herein by reference.

TECHNICAL FIELD

This invention relates generally to economized vapor compression systems and, more particularly, to a method and apparatus for controlling the flow within a flash tank economizer vapor line.

BACKGROUND OF THE INVENTION

A vapor compression system consists of a compressor, a heat rejection heat exchanger or gas cooler, an expansion device, and an evaporator. Economizer cycles are sometimes employed to increase the efficiency and/or capacity of the system. Economizer cycles operate by expanding the refrigerant leaving the heat rejecting heat exchanger to an intermediate pressure and separating the refrigerant flow into two streams. One stream is sent to the heat absorbing heat exchanger, and the other is sent to cool the flow between two compression stages. In one form of an economizer cycle, a flash tank is used to perform the separation. In an economizer cycle with flash tank, a refrigerant discharged from the gas cooler passes through a first expansion device, and its pressure is reduced. Refrigerant collects in the flash tank as part liquid and part vapor. The vapor refrigerant is used to cool refrigerant exhaust as it exits a first compression device, and the liquid refrigerant is further expanded by a second expansion device before entering the evaporator. Such a flash tank economizer is particularly useful when operating in transcritical conditions, such as are required when carbon dioxide is used as the working fluid, and is described in U.S. Pat. No. 6,385,980, assigned to the assignee of the present invention. In the non-economized mode the vapor line connecting the flash tank with the compressor mid-stage is closed and the entire refrigerant mass flow rate entering the flash tank is directed to the second expansion stage.

When the system operates in the economized mode, it is desirable to prevent the reversal of the flow direction in the economizer vapor line, e.g., from the compressor to the flash tank. That is, if the pressure in the compressor mid-stage is higher than in the flash tank, the flow direction in the economizer vapor line will be reversed, resulting in flow from the compressor through the economizer vapor line into the flash tank. Flow reversal in the economizer vapor line reduces the system cooling capacity and energy efficiency. Flow reversal will generally result when the compressor mid-stage pressure exceeds the pressure in the flash tank and can occur at certain operating conditions, dictated by the temperature at the heat sink and heat source and the specifics of the system design, such as heat exchanger size and compressor size.

In U.S. Pat. No. 6,202,438, assigned to Scroll Technologies, a former subsidiary of the present assignee, there is disclosed an economized refrigeration circuit with a check valve disposed within the compressor to prevent the return flow of refrigerant from the compressor to the economizer. However, that check valve is employed only for that purpose, and a separate economizer valve is employed to turn the economizer on or off. Further, the economizer is not of the flash tank type, and the manner in which it operates is different from the flash tank economizer of the present invention.

Due to the thermophysical properties of $CO_2$, the refrigeration system can operate in both the subcritical and transcritical modes. The subcritical mode is similar to the operation of systems with conventional refrigerants. In the transcritical mode the refrigerant pressure in the heat rejection heat exchanger, and possibly in the flash tank, is above the critical pressure, while the evaporator operates as in the subcritical mode. If the flash tank pressure is above the critical pressure, the separation of the refrigerant into liquid and vapor phases will not occur as desired since a supercritical fluid does not form a distinct liquid and vapor phase.

DISCLOSURE OF THE INVENTION

In accordance with one aspect of the invention, a flash tank economizer includes a control for preventing the operation of the economizer during periods in which the pressure in the flash tank is above the critical pressure of the refrigerant.

In accordance with another aspect of the invention, the control is also responsive to the pressure difference between the flash tank and a mid-stage of the compressor so as to prevent operation of the economizer during periods in which the pressure at the mid-stage is greater than the pressure in the flash tank.

In accordance with yet another aspect of the invention, provision is made to actively reduce the pressure in the flash tank when it is in the supercritical condition.

In accordance with yet another aspect of the invention, provision is made to directly or indirectly measure pressure at a mid-stage of a compressor or pressure at a flash tank.

In accordance with yet another aspect of the invention there is provided a vapor compression system of the type having in serial refrigerant flow relationship a compressor, a heat rejection heat exchanger, an expansion device and an evaporator, including a flash tank economizer disposed in serial flow relationship between the heat rejection heat exchanger and the expansion device, the flash tank economizer including a flash tank, a first flow control device disposed between the heat rejection heat exchanger and the flash tank, an economizer vapor line to fluidly interconnect the flash tank to a mid-stage of the compressor, a second flow control device disposed in the economizer vapor line, and a controller to control the second flow control device to prevent flow in the economizer line when pressure in said flash tank equals or exceeds the critical pressure of the refrigerant.

In accordance with yet another aspect of the invention, there is provided a method of controlling the flow of refrigerant in a vapor compression system of the type having in serial refrigerant flow relationship a compressor, a condenser heat rejection heat exchanger, a first expansion device, a flash tank, a flow control device, a second expansion device and an evaporator, including fluidly interconnecting the flash tank to a mid-stage of the compressor by way of an economizer vapor line, providing a flow control device in the economizer vapor line, determining pressure in the flash tank, and responsively turning off the second flow control device to prevent flow in the economizer line when the pressure in the flash thank equals or exceeds the critical pressure of the refrigerant or when a mid-stage pressure of the compressor is greater than the pressure in the flash tank.

In accordance with yet another aspect of the invention, there is provided a method of controlling the flow of refrigerant in a vapor compression system of the type having in serial refrigerant flow relationship a compressor, a heat rejection heat exchanger, a first expansion device, a flash tank, a flow control device, a second expansion device and an evaporator, including fluidly interconnecting the flash tank to a mid-stage of the compressor by way of an economizer vapor line, providing a flow control device in the economizer vapor line, determining pressure in the flash tank, and responsively turning off the second flow control device in the economizer line when the pressure in the flash thank equals or exceeds the critical pressure of the refrigerant or when a mid-stage pressure of the compressor is greater than the pressure in the flash tank.

DETAILED DESCRIPTION OF EMBODIMENTS

Figure 1:
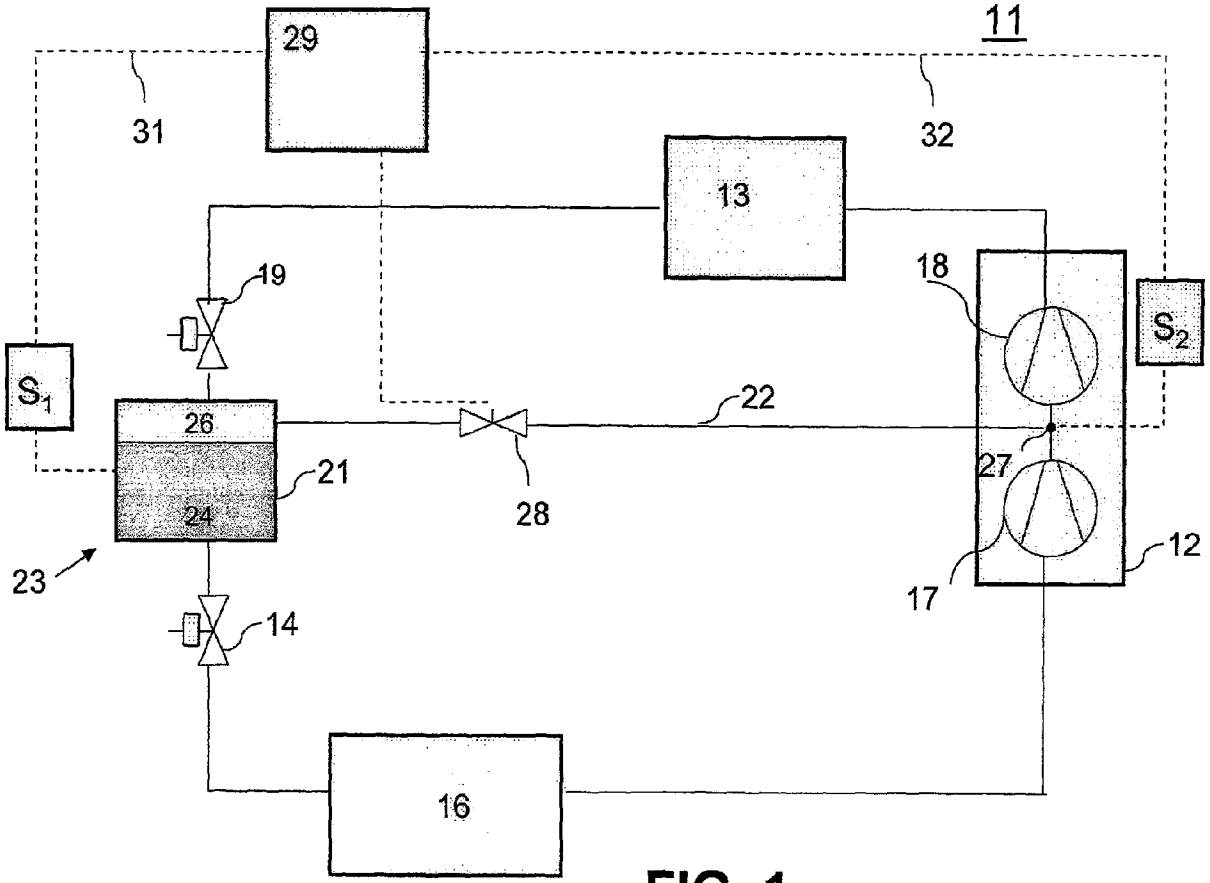
FIG. 1 is a schematic illustration of a vapor compression system with the present invention incorporated therein.

Shown in FIG. 1 is a vapor compression system that includes, in serial flow relationship, a compressor 12, a refrigerant heat rejection heat exchanger 13, an expansion device 14, and a heat absorption heat exchanger 16.

The compressor 12, which functions to compress and circulate refrigerant through the refrigeration circuit, may comprise a single, multi-stage compressor having a lower compression stage 17 and higher compression stage 18 as shown and may comprise a scroll compressor, a screw compressor having stage compression pockets, a reciprocating compressor having at least a first bank of cylinders and a second bank of cylinders, or a multi-stage compressor. Alternatively, the compressor 12 may comprise a pair of single stage compressors connected in series refrigerant flow relationship. In one embodiment, the compressor 12 can comprise a scroll compressor or a multi-speed compressor (e.g., two-speed compressor).

When the vapor compression system 11 is operating in a transcritical cycle, such as when charged with carbon dioxide refrigerant and operating at compressor discharge pressures in excess of the critical pressure point of carbon dioxide, the refrigerant heat rejection heat exchanger 13 operates at supercritical pressures and functions as a refrigerant vapor cooler, thus only cooling the refrigerant vapor and not condensing it to a liquid. The heat process of condensation will be described hereinbelow.

The expansion device 14 may comprise an electrical expansion valve, a thermostatic expansion valve or a fixed orifice device, such as a capillary tube, all of which operate to expand the liquid refrigerant flowing to the expansion device 14 to a mixture of liquid and vapor as it enters the heat absorption heat exchanger 16.

The heat absorption heat exchanger 16, commonly referred to as an evaporator, operates at a subcritical pressures and functions to cool a gas or liquid passing over the heat exchanger as the refrigerant therein is heated and evaporated. The heated vapor then passes to the inlet of the compressor 12.

Disposed in serial flow relationship between the heat rejection heat exchanger 13 and the expansion device 14 is a flow control device 19 and a flash tank 21. The flow control device 19 and the flash tank 21, together with an economizer vapor line 22 fluidly interconnecting the flash tank 21 to a mid-stage of the compressor 12, comprise a flash tank economizer 23.

In operation, the refrigerant exiting the heat rejection heat exchanger 13 passes through the flow control device 19 where it is expanded to thereby reduce its pressure. The resulting mixture of liquid and vapor then enters the flash tank 21, with the liquid 24 settling to the bottom and the vapor 26 residing in the top portion of the flash tank 21. The liquid refrigerant 24 passes to the expansion device 14 where it is expanded as described hereinabove.

In a process known as economized operation, the vapor 26 passes along the economizer vapor line 22 to a mid-stage point 27 of the compressor 12 to cool the refrigerant that exits the low compression stage 17 to thereby increase the cooling capacity of the system. Operation of such a flash tank economizer is described in greater detail in U.S. Pat. No. 6,385,980, assigned to the assignee of the present invention and incorporated herein by reference.

Various problems arise with respect to use of such a flash tank economizer. First, if the pressure at the compressor mid-stage point 27 is greater than the pressure in the flash tank 21, refrigerant will tend to flow from the compressor 12 to the flash tank 21, resulting in a substantial reduction of system efficiency. Secondly, if the pressure in the flash tank 21 exceeds the critical pressure of the refrigerant (e.g., 1070 psia or 7.38 MPa for carbon dioxide), then the separation of liquid and vapor in the flash tank 21 will not occur as desired and the economizer will not function properly. Both of these problems can be addressed by way of a flow control device 28 placed in the economizer line 22 as shown.

The flow control device 28, which in one form is an electronically controlled flow control device such as a solenoid valve, is controlled by a controller 29 in response to sensed conditions at the flash tank 21 and at the compressor 12. For example, a sensor $S_1$ senses an operational condition at the flash tank 21, and a sensor $S_2$ senses an operational condition at the mid-stage point 27 of the compressor 12. The sensed conditions then cause the controller 29 to either open the flow control device 28 to permit economized operation or to close the flow control device 28 to thereby turn off the economizer.

In one embodiment, the sensor $S_1$ senses the pressure in the flash tank 21 and sends a signal along line 31 to the control 29. The controller 29 then compares that sensed pressure with the critical pressure for the refrigerant being used, and if the sensed pressure is greater than the critical pressure, then the control 29 acts to close the flow control device 28.

In another embodiment, the sensor $S_1$ senses the temperature of the refrigerant in the flash tank 21, with the temperature signal then being sent along line 31 to the controller 29. If the controller 29 determines that the refrigerant temperature is below the critical temperature of the particular refrigerant (e.g. 31.1° C. or 88° F. for carbon dioxide), the flash tank pressure can be estimated from the corresponding refrigerant vapor pressure (this assumes that the refrigerant in the flash tank is in a two-phase state, which is a reasonable assumption for practical purposes), and then the flow control 28 will be responsively either placed in the open or close position as described hereinabove.

In another embodiment, the operational condition (e.g., pressure) in the flash tank 21 and/or the operational condition (e.g., pressure) at the mid-stage point 27 of the compressor 12 can be indirectly sensed or calculated from other vapor compression system operational conditions. Accordingly, the pressure in the flash tank 21 can be determined by direct measurement (e.g., sensed by a sensor) or by indirect measurement (e.g., calculated by related parameters such as component characteristics or sensor readings).

Recognizing the second problem as discussed hereinabove, the controller is also used for preventing the reverse flow of the refrigerant in the economizer vapor line 22. That is, the sensor $S_2$ senses the pressure at the compressor mid-stage 27 and sends a pressure signal along line 32 to the controller 29. The controller 29 then compares the pressure in the flash tank 21 with that at the compressor mid-stage 27. If it is determined that the pressure at the compressor mid-stage 27 is greater than that in the flash tank 21, the flow control device 28 is operated or closed such that the reverse flow cannot occur or is sufficiently reduced.

Figure 4:
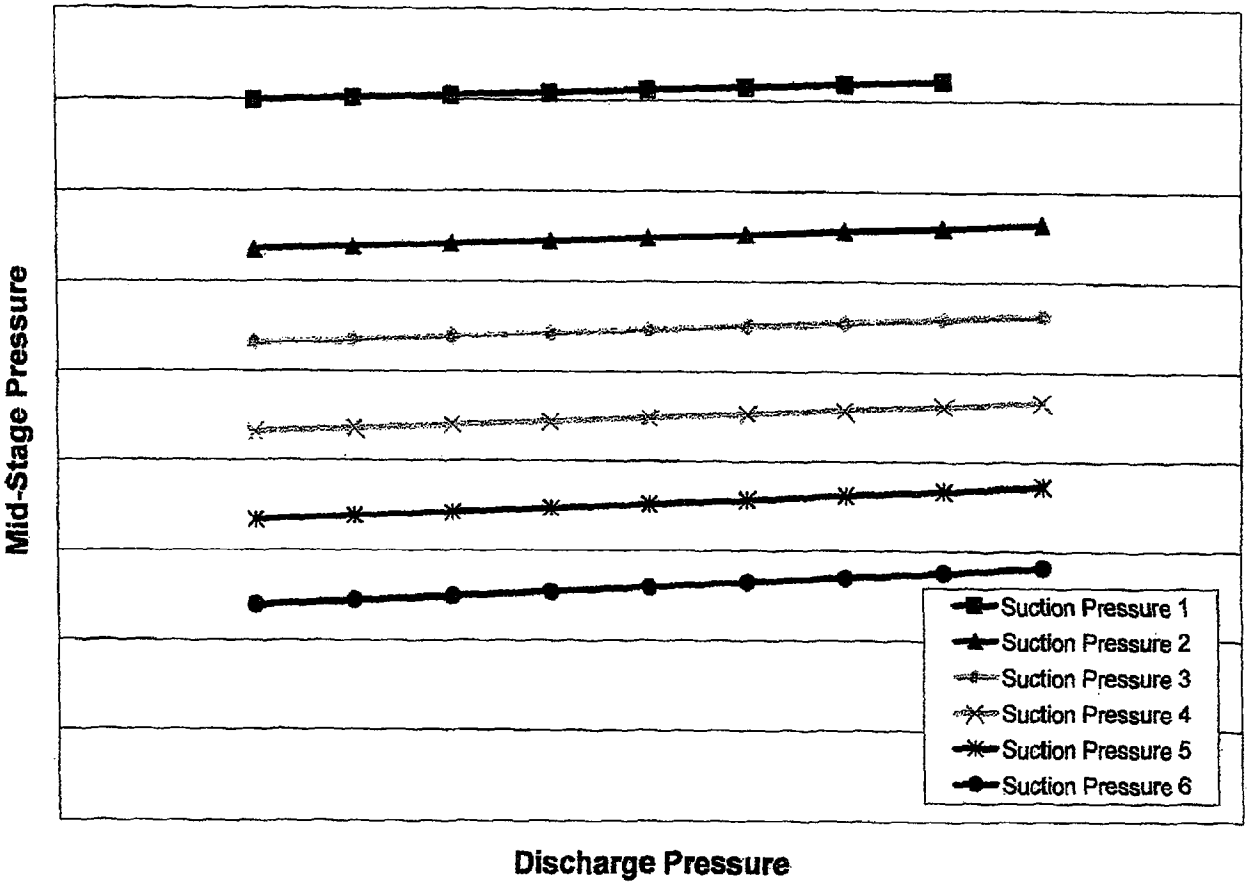
FIG. 4 is a diagram graphically showing exemplary compressor mid-stage pressure as a function of compressor discharge pressure for various compressor suction pressures.

An exemplary indirect determination for the compressor mid-stage pressure will now be described. FIG. 4 shows the compressor mid-stage pressure as a function of the compressor discharge pressure for various compressor suction pressures. As shown in FIG. 4, the compressor mid-stage pressure can be determined when the suction and discharge pressure of the compressor 12 are known. The same information can be written in the form of an exemplary two-dimensional lookup table below.

| | P Suction 1 | P Suction 2 | P Suction 3 | P Suction 4 |
|---|---|---|---|---|
| P Discharge 1 | P Mid-Stage 1, 1 | P Mid-Stage 1, 2 | P Mid-Stage 1, 3 | P Mid-Stage 1, 4 |
| P Discharge 2 | P Mid-Stage 2, 1 | P Mid-Stage 2, 2 | P Mid-Stage 2, 3 | P Mid-Stage 2, 4 |
| P Discharge 3 | P Mid-Stage 3, 1 | P Mid-Stage 3, 2 | P Mid-Stage 3, 3 | P Mid-Stage 3, 4 |
| P Discharge 4 | P Mid-Stage 4, 1 | P Mid-Stage 4, 2 | P Mid-Stage 4, 3 | P Mid-Stage 4, 4 |

It should be understood that the values of the suction, discharge, and mid-stage pressures are specific to the compressor design and operating conditions. If the operating conditions for a given machine change, for instance if the suction superheat changes, the values of the mid-stage pressure for a particular combination of suction and discharge pressure may change. This is even more pronounced if the compressor design allows to independently control the speed of the two compressor stages, for instance if the two stages are driven by different motors, for which the speed can be adjusted independently from each other. In this case, an additional dimension can be added to the graph or lookup table. For example, an additional dimension can be accomplished by providing additional graphs or tables, each for a constant value of the additional variable.

Figure 2:
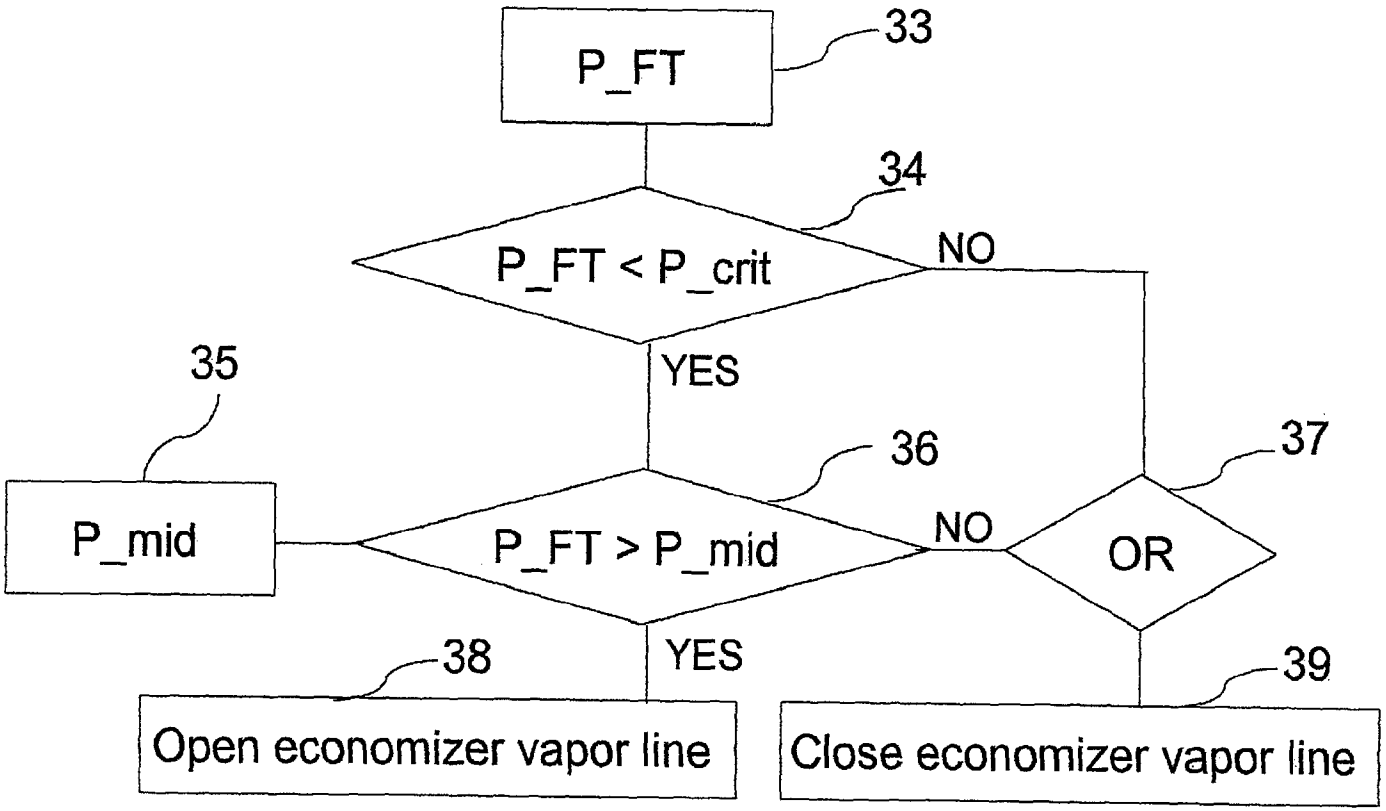
FIG. 2 is a flow diagram showing the operation of the present invention.

Referring now to FIG. 2, the process as performed by the control 29 is shown in block diagram form. In block 33, the pressure at the flash tank is determined (e.g., sensed or calculated), and in block 34 that pressure is compared with the critical pressure for the particular refrigerant involved. If the flash tank pressure is less than the critical pressure, then the controller 29 proceeds to block 36, and if the flash tank pressure is equal to or greater than the critical pressure, it proceeds to block 37.

In block 36, the flash tank pressure is compared with the compressor mid-stage pressure from block 35, and if it is greater than the compressor mid-stage pressure, then the controller proceeds to block 38 where the economizer vapor line 22 is opened. Again, the compressor mid-stage pressure can be directly or indirectly determined (block 35). If the flash tank pressure is not greater than the compressor mid-stage pressure, then the controller 29 proceeds to block 37. If, at block 37, a "no" signal is received from either block 34 or 36, the economizer vapor line 22 is closed at block 39.

It should be recognized that the flow control device 28 may be of various types. For example, it may be an electronically controlled flow control device that is controlled in response to both the absolute flash tank pressure and the pressure difference between the flash tank pressure and compressor mid-stage pressure in order to perform the exemplary functions as described hereinabove. Alternatively, it may be an electronically controlled flow control device that responds only to the absolute flash tank pressure, and a separate flow control device such as a check valve, which is responsive to the pressure difference between the flash tank pressure and compressor mid-stage pressure so as to control or prevent flow in the reverse direction. It may also be a combined electronically controlled and directional flow control device (i.e., a combined solenoid and check valve), controlled according to both the flash tank pressure and by the pressure difference between the flash tank pressure and compressor mid-stage pressure.

Figure 3:
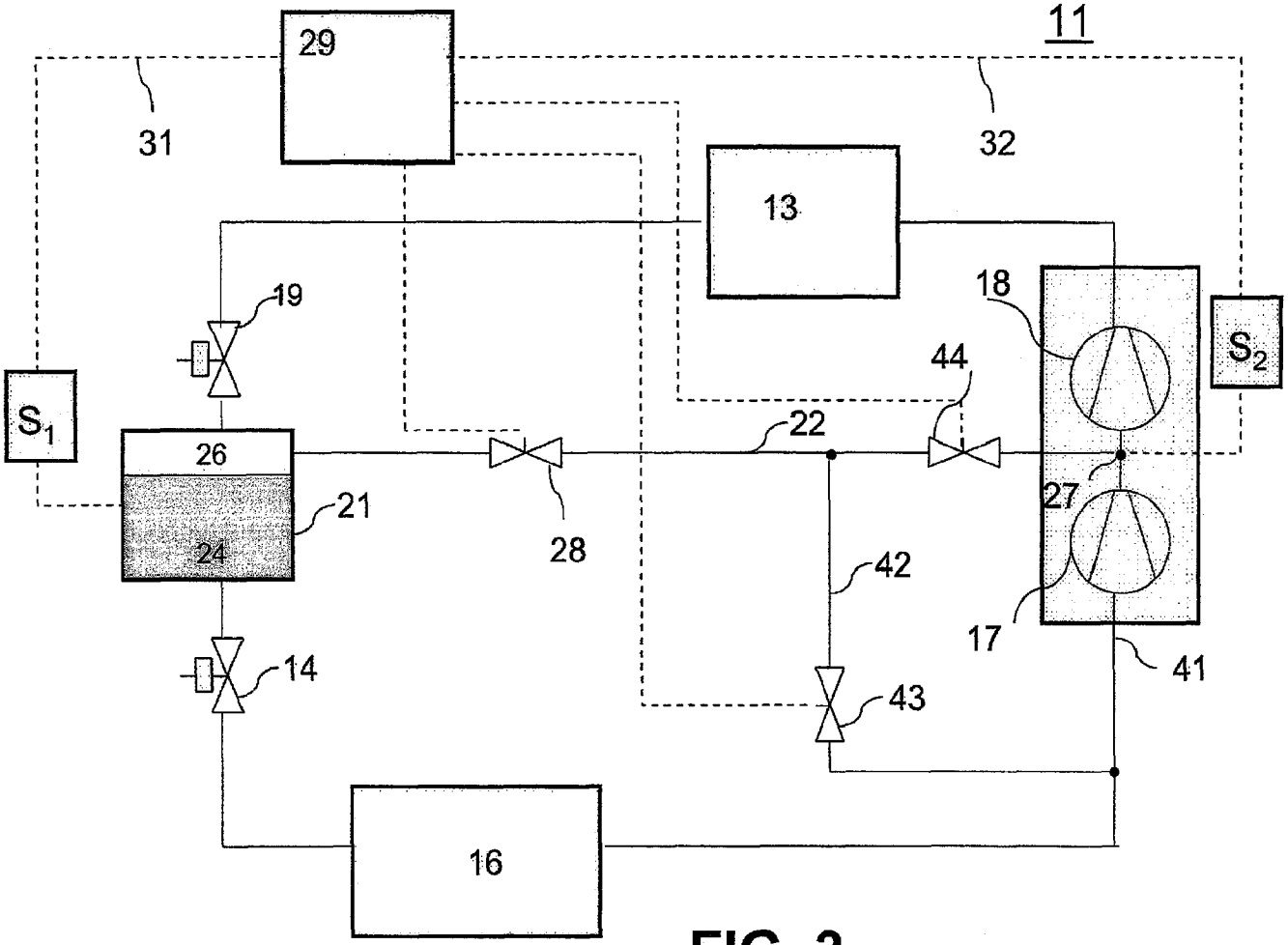
FIG. 3 is a schematic illustration of an alternative embodiment of the invention.

Referring now to FIG. 3, an alternative embodiment of the invention is shown wherein the flash tank pressure is actively controlled. That is, during periods in which the pressure in the flash tank is supercritical as, for example, during startup of the system at high ambient temperatures, the flash tank pressure can be reduced to subcritical conditions by draining some of the refrigerant mass (which may be in a vapor and/or liquid form) from the flash tank. This is accomplished by selectively fluidly interconnecting the economizer vapor line 22 to an inlet 41 of the lower compression stage 17 by way of a line 42 and flow control device 43. Thus, when it is desired to reduce the pressure in the flash tank 21 from a supercritical condition, the flow control device 28 and the flow control device 43 are opened so as to allow a portion of the refrigerant from the flash tank 21 to drain into the inlet 41. During this draining mode, the flow control device 44 is closed to prevent supercritical refrigerant from entering the compressor mid-stage 27. After the pressure in the flash tank 21 has been reduced to a subcritical condition, the flow control device 43 may be closed and the flow control device 44 opened in order to permit operation to proceed as described hereinabove.

It should be recognized that such a draining procedure may result in some liquid refrigerant entering the compressor inlet. Although this is generally undesirable, it may occur for short periods of time without any significant damage to the compressor.

While the present invention has been described with reference to a number of specific embodiments, it will be understood that the true spirit and scope of the invention should be determined only with respect to claims that can be supported by the present specification. Further, while in numerous cases herein wherein systems and apparatuses and methods are described as having a certain number of elements it will be understood that such systems, apparatuses and methods can be practiced with fewer than the mentioned certain number of elements. Also, while a number of particular embodiments have been described, it will be understood that features and aspects that have been described with reference to each particular embodiment can be used with each remaining particularly described embodiment. For example, features or aspects described using FIG. 1 or FIG. 2 can be applied to embodiments described using FIG. 3.

We claim:

1. A vapor compression system of the type having in serial refrigerant flow relationship a compressor, a heat rejection heat exchanger, an expansion device and an evaporator, comprising:

a flash tank economizer disposed in serial flow relationship between the heat rejection heat exchanger and the expansion device, said flash tank economizer including:

a flash tank;

a first flow control device disposed between the heat rejection heat exchanger and said flash tank;

an economizer vapor line to fluidly interconnect said flash tank to a mid-stage of the compressor;

a second flow control device disposed in said economizer vapor line;

a third flow control device positioned in a line fluidly interconnecting said economizer vapor line to an inlet of said compressor separate from the mid-stage of the compressor, the line fluidly connecting the economizer vapor line to a point downstream of the evaporator and upstream of the inlet of said compressor with respect to the serial refrigerant flow; and a controller to control said second flow control device and said third flow control device such that during periods in which pressure in said flash tank equals or exceeds the critical pressure of the refrigerant, said second and third flow control devices open to thereby drain refrigerant from said flash tank to thereby reduce the pressure in said flash tank to a subcritical condition.

2. A vapor compression system as set forth in claim 1, further comprising a sensor for sensing a condition indicative of the pressure in said flash tank.

3. A vapor compression system as set forth in claim 2 wherein said sensor is a pressure sensor or a temperature sensor.

4. A vapor compression system as set forth in claim 1, said controller to determine pressure at said compressor mid-stage, said controller to compare said compressor mid-stage pressure with the pressure in said flash tank.

5. A vapor compression system as set forth in claim 4, said controller to cause said second flow control device to operate such that when said compressor mid-stage pressure is determined to be greater than the pressure in the flash tank, no flow will occur in the economizer vapor line.

6. A vapor compression system as set forth in claim 4, further comprising a second sensor for sensing the pressure at said compressor mid-stage.

7. A vapor compression system as set forth in claim 4, said controller indirectly measuring the pressure at said compressor mid-stage.

8. A vapor compression system as set forth in claim 4, wherein said second flow control device comprises an electronically controlled flow control device which is closed when either the flash tank pressure is equal to or greater than the refrigerant critical pressure or the compressor mid-stage pressure is greater than the flash tank pressure.

9. A vapor compression system of the type having in serial refrigerant flow relationship a compressor, a heat rejection heat exchanger, an expansion device and an evaporator, comprising:

a flash tank economizer disposed in serial flow relationship between the heat rejection heat exchanger and the expansion device, said flash tank economizer including:

a flash tank;

a first flow control device disposed between the heat rejection heat exchanger and said flash tank;

an economizer vapor line to fluidly interconnect said flash tank to a mid-stage of the compressor;

a second flow control device disposed in said economizer vapor line;

a third flow control device positioned in a line fluidly interconnecting said economizer vapor line to an inlet of said compressor separate from the mid-stage of the compressor, the line fluidly connecting the economizer vapor line to a point downstream of the evaporator and upstream of the inlet of said compressor with respect to the serial refrigerant flow;

a fourth flow control device disposed within the economizer vapor line between the compressor mid-stage and a point in which the line is fluidly connected to said economizer vapor line;

a controller to control said second flow control device and said third flow control device such that during periods in which pressure in said flash tank equals or exceeds the critical pressure of the refrigerant, said second and third flow control devices open to thereby drain refrigerant from said flash tank to thereby reduce the pressure in said flash tank to a subcritical condition;

said controller to control said fourth flow control device such that when the second and third flow control devices open to thereby drain refrigerant from said flash tank, the fourth flow control device is closed in order to prevent the refrigerant from entering the compressor mid-stage.

* * * * *